US006457753B1

(12) United States Patent
Wegge

(10) Patent No.: US 6,457,753 B1
(45) Date of Patent: Oct. 1, 2002

(54) DOOR LOCK FOR A MOTOR VEHICLE

(75) Inventor: Martin Wegge, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/400,874

(22) Filed: Sep. 22, 1999

(30) Foreign Application Priority Data

Sep. 22, 1998 (DE) ..... 198 43 422

(51) Int. Cl.[7] ..... F05C 3/06; F05C 3/16

(52) U.S. Cl. ..... 292/216; 292/DIG. 53; 292/DIG. 64

(58) Field of Search ..... 292/216, DIG. 53, 292/DIG. 64, 201, DIG. 23; 70/416, 417

(56) References Cited

U.S. PATENT DOCUMENTS

| | | | | | |
|---|---|---|---|---|---|
| 4,052,094 | A | * | 10/1977 | Widen | 292/336.3 |
| 4,575,138 | A | * | 3/1986 | Nakamura et al. | 292/216 |
| 4,762,348 | A | * | 8/1988 | Matsumoto | 292/201 |
| 4,885,954 | A | * | 12/1989 | Wanlass | 74/625 |
| 4,898,414 | A | * | 2/1990 | Yamada | 292/337 |
| 4,986,098 | A | * | 1/1991 | Fisher | 70/262 |
| 5,308,129 | A | * | 5/1994 | Hlavaty | 292/216 |
| 5,605,563 | A | * | 2/1997 | Kapes | 292/196 |
| 5,713,613 | A | * | 2/1998 | Honma et al. | 292/201 |
| 5,746,076 | A | * | 5/1998 | Inoue | 70/277 |
| 6,079,757 | A | * | 6/2000 | Aubry | 292/201 |
| 6,109,674 | A | * | 8/2000 | Bartel et al. | 292/337 |
| 6,199,923 | B1 | * | 3/2001 | Rice et al. | 292/216 |
| 6,240,754 | B1 | * | 6/2001 | Petersen | 70/417 |

FOREIGN PATENT DOCUMENTS

DE 25 22 301 A1 12/1976

* cited by examiner

*Primary Examiner*—Anthony Knight
*Assistant Examiner*—John P. Walsh
(74) *Attorney, Agent, or Firm*—Crowell & Moring LLP

(57) ABSTRACT

A door lock of a motor vehicle having a premounted lock subassembly which is arranged in a hollow space of a vehicle door. The door lock is fastened on the rearward frontal area of the vehicle door and has a lock support on which a latch as well as a detent pawl, which locks the latch in the closed position, are adjustably fastened. The door has a wall area which bounds the hollow space from the occupant compartment and has a passage opening through which a transmission element connected with the lock subassembly extends to a lock operating element arranged outside the hollow space. An area of the lock subassembly covers the passage opening. The transmission element, which is connected with the lock operating element can be connected through the passage opening with an assigned connecting element of the lock subassembly after the locking subassembly is mounted to the door.

17 Claims, 2 Drawing Sheets

DOOR LOCK FOR A MOTOR VEHICLE

BACKGROUND AND SUMMARY OF THE INVENTION

The invention relates to a door lock of a motor vehicle.

This application claims the priority of 198 43 422.7, filed Sep. 22, 1998, the disclosure of which is expressly incorporated by reference herein.

A door lock of the above-mentioned type for a motor vehicle is disclosed, for example, in German Patent Document DE-OS 25 22 301. A premounted lock subassembly with a lock latch and a detent pawl interacting therewith as well as a central locking system drive is arranged in a hollow space of a vehicle door and is fastened on the rearward frontal area of the vehicle door.

The door lock is connected by means of transmission elements, for example, with an interior securing knob, which is vertically adjustable on the interior side of the door, with an interior door grip and with an electric line of a central locking system. A window pane may be lowered into the hollow space of the vehicle door, into which moisture can penetrate in wet weather. The plug-type connection, which is situated in the hollow space for connecting the electric line with the lock subassembly, should be constructed in a water-tight manner in order to avoid operational disturbances caused by water penetrating into the plug-type connection. The linkage elements or transmission elements of the door lock which lead out of the hollow space by way of passage openings in a wall area and are connected, for example, with an interior door grip, must be sealed off at the passage openings if a transfer of moisture is to be prevented from the hollow space, for example, into the passenger compartment or into a space adjoining the hollow space. This requires increased expenditures if these elements are arranged in an adjustable manner. When the lock subassembly is already mounted, the mounting of the linkage elements or transmission elements is possible only as long as the hollow space is still accessible. Sound or water insulation, for example, made of a foam material, which partially or completely closes off the hollow space can be inserted into the hollow space only after the mounting of the linkage elements or transmission elements, whereby the manufacturing of the vehicle door is made more difficult.

It is an object of the invention to provide a door lock of a motor vehicle which permits a simpler manufacturing of a vehicle door provided with the door lock.

According to the invention, the connection of the transmission elements with the elements of the lock subassembly can take place at any later point in time after the premounted lock subassembly has been inserted into the hollow space of the vehicle door and has been fastened in the rearward area of the vehicle door. This is advantageous when manufacturing the vehicle door provided with the door lock since the transmission elements can be separately premounted, for example, on the interior side of a door covering. In addition, when the door covering is not yet mounted, a sound insulation can be inserted in a simpler manner into the hollow space of the vehicle door and the door covering does not become dirty during the process. If the transmission element is an electric line, which is to be connected by way of a plug-type connection with the lock subassembly, a water-tight construction of the plug-type connection is not required.

BRIEF DESCRIPTION OF THE DRAWINGS

An embodiment of the invention is explained in detail by means of the drawings.

DETAILED DESCRIPTION OF THE DRAWINGS

Figure 1:
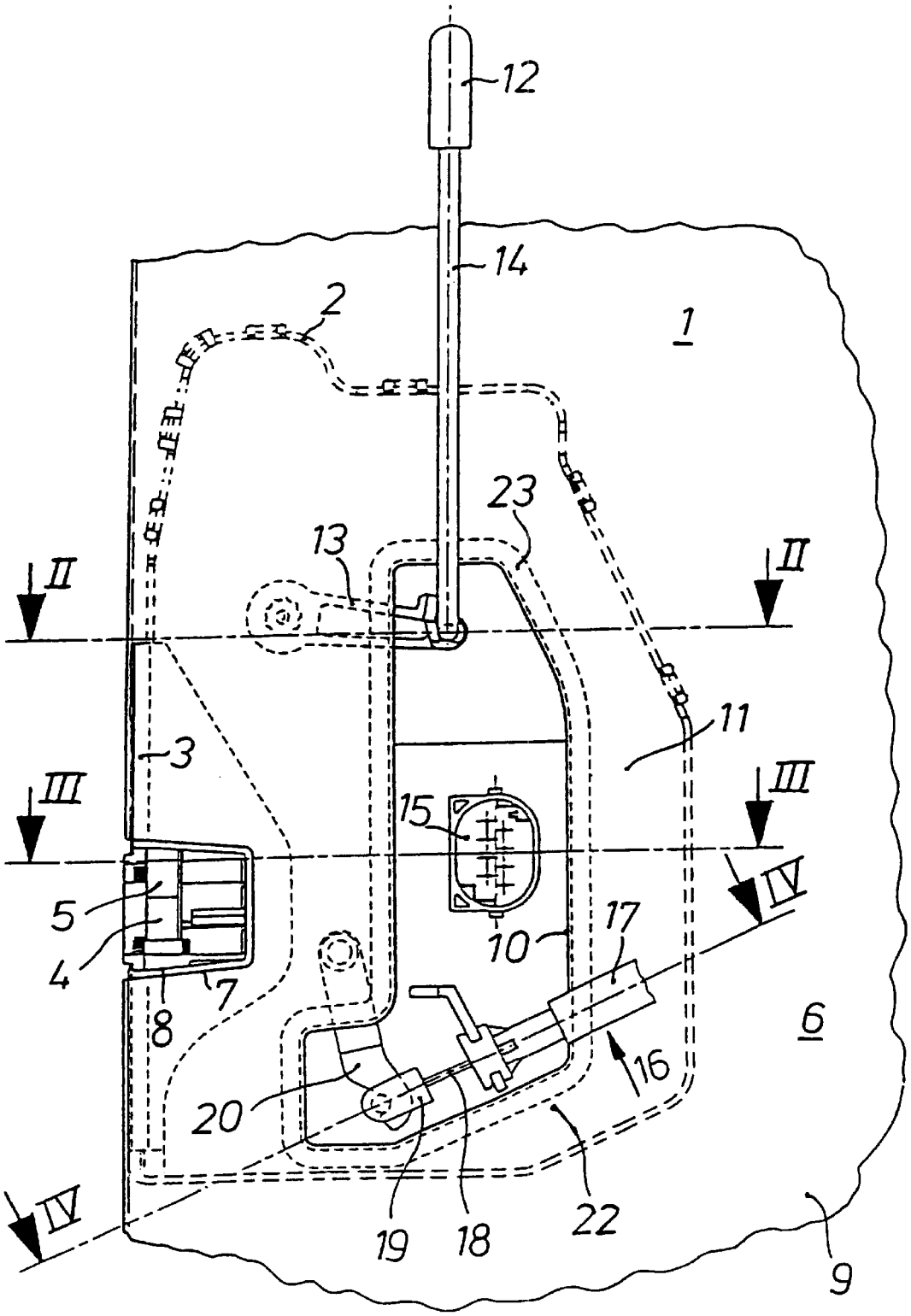
FIG. 1 is a view of the door cutout receiving the lock subassembly viewed from the direction of the occupant compartment of the motor vehicle.

The door lock illustrated in FIG. 1 on a left forward motor vehicle door 1 has a premounted lock subassembly 2 which, in the top view, has an approximately angular lock support 3, on which a latch 4, which is illustrated only schematically, and a detent pawl 5, which locks the latch in its locked position, are adjustably fastened. The premounted lock subassembly 2, which is arranged in a hollow space 6 of the left forward vehicle door 1 of motor vehicle, is fastened on the rearward frontal area of the vehicle door 1. The hollow space 6 has an open construction in its rearward area 7 and the lock subassembly 2 is constructed with an insertion slot 8 so that a bolt stationarily arranged on the vehicle body can interact with the latch 4.

The hollow space 6 of the vehicle door 1 is bounded from the direction of the occupant compartment by a wall area 9 in which a passage opening 10 is constructed. The passage opening 10 is covered by a leg area 11 of the lock subassembly 2 which, in the top view, has an angular construction. Several lock operating elements permit a switching or operating of assigned parts of the lock. For example, by the vertical displacement of an interior securing knob 12, which is vertically adjustable on the interior side of the door, a swivel lever 13 of the lock subassembly 2 can be adjusted into a locking position. In this way the door lock, which is connected with an exterior grip of the door, cannot be opened by the swivelling of the exterior grip of the door. The connection point of a transmission element 14, which supports and connects the interior securing knob 12 with the swivel lever 13, viewed in the transverse direction of the vehicle, is situated inside the passage opening 10.

Figure 3:
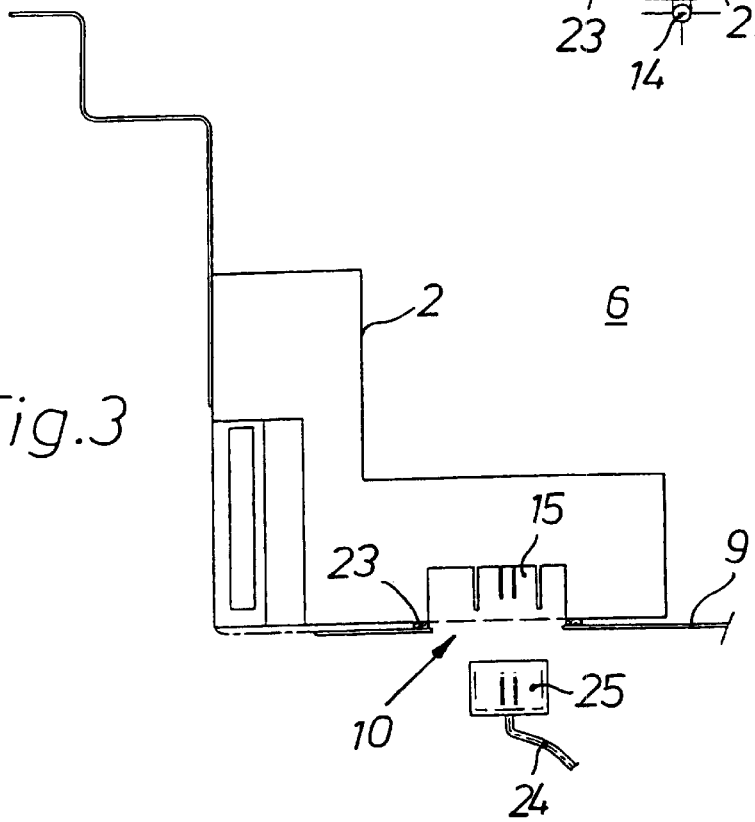
FIG. 3 is a sectional view along intersection Line III—III in FIG. 1.

In addition, the door lock can be brought into a securing position by way of an electric or electronic central locking system. For controlling the door lock as shown in FIG. 3, the central locking system has an electric line 24 with a plug 25 which can be fitted through the passage opening 10 into the plug receiving device 15 on the lock subassembly 2.

The interior door grip, which is not shown, is connected with a Bowden cable 16 which carries a cable 18 in a stationary cable receiving device 17. Cable 18 is connected by way of a cable end piece 19 with a swivel part of the lock subassembly 2. The swivel part 20 is connected with the detent pawl 5 so that, by the operation of the interior grip of the door, the cable 18 and the swivel part 20 are adjusted and the detent pawl 5 is thereby disengaged from the latch 4.

The connection point of the cable end part 19 with the swivel part 20, viewed in the transverse direction of the vehicle, is situated inside the passage opening 10. Since the indicated connection points are situated in the area of the passage opening 10, the operating and transmission elements, such as an electric line, can be arranged outside the hollow space 6 and, at an arbitrary later point in time, can be connected with the assigned elements of the lock subassembly by way of the passage opening 10, after the lock subassembly was mounted on the vehicle door. If the operating and transmission elements are not yet mounted and the door covering is preferably not yet mounted, in a simpler manner and without dirtying the door covering, after the fastening of the lock subassembly, a sound insulation can be inserted in the hollow space which can receive a lateral window pane. A secure sealing of the lock subassembly 2 with respect to an edge area 22 of the wall area 9 adjoining the passage opening 10 can take place by placing a seal 23 in-between, which is placed around the passage opening 10.

Figure 2:
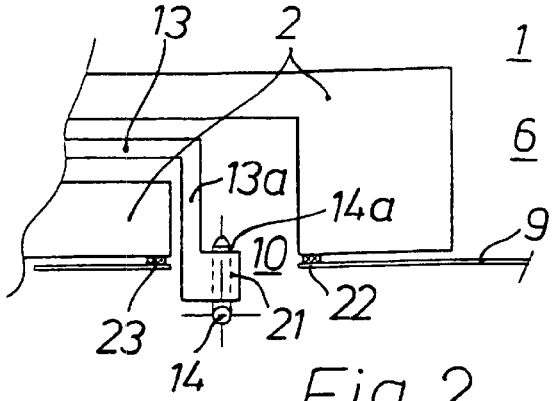
FIG. 2 is a sectional view along intersection Line II—II in FIG. 1.

As illustrated in FIG. 2, the swivel lever 13 with the transverse web 13*a* projects through the passage opening 10 slightly out of the hollow space 6 and is provided at this end with a plug-in opening 21 extending in the transverse direction of the door. After the mounting of the premounted lock subassembly 2 on the vehicle door 1, at an arbitrary later point in time, for example, during the mounting of the door covering, the transmission element 14 or, in the present case, a bent leg 14a of the transmission element 14 can be inserted laterally from the vehicle occupant compartment, in the plug-in opening 21 and, if required, can be fixed in a suitable manner.

FIG. 3 illustrates another embodiment of the invention wherein the plug 25, which is connected with the electric line 24 of the central locking system, at an arbitrary point in time after the mounting of the lock subassembly 2, for example, during the mounting of a door covering, on the interior side of which the electric line 24 can be fixed, is to be connected with the plug receiving device 15 on the lock subassembly which, viewed in the transverse direction of the vehicle, is arranged in the passage opening 10.

Figure 4:
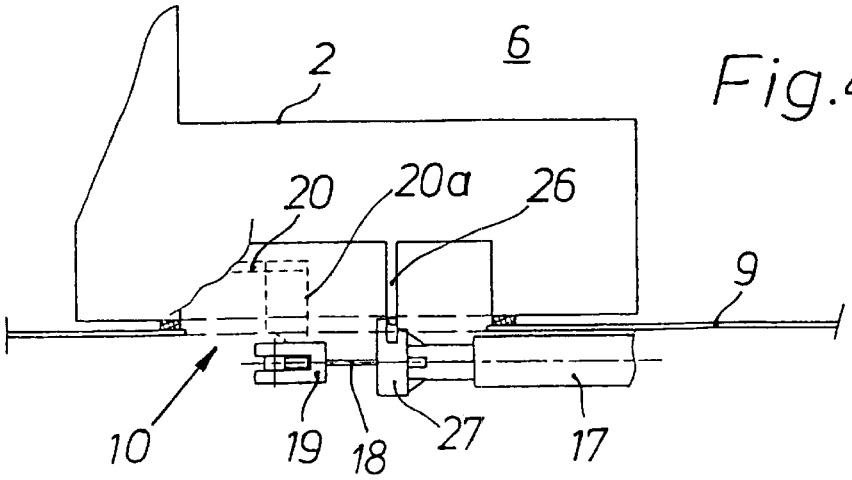
FIG. 4 is a sectional view along intersection Line IV—IV in FIG. 1.

The top view according to FIG. 4 shows that the swivel part 20 connected with the detent pawl projects with its lateral arm 20*a* slightly through the passage opening 10 out of the hollow space 6 and, at this point, is connected in an articulated manner with the cable end piece 19 of the cable 18. In the present embodiment, the cable receiving device 17 is stationarily held on a web 26 of the lock subassembly 2, on which a holding part 27 of the cable receiving device 17 can, for example, be fixed by snapping or can be detachably fixed in another manner.

In the embodiment, several transmission elements arranged outside the hollow space are connected through a common passage opening with an assigned element of the lock subassembly. The element of the lock subassembly may also be a plug or a plug receiving device which is connected with the lock subassembly by way of a short electric line, which lock subassembly projects through the passage opening slightly out of the hollow space. In the wall area, several passage openings may also be constructed through which, in each case, a single transmission element or several transmission elements are to be connected with the assigned elements of the lock subassembly. Since the passage opening has been covered by an area of the lock subassembly, a possibly used plug connection must not be constructed in a water-tight manner. A seal between the lock subassembly and the wall area used in the embodiment can also be eliminated if the lock subassembly sufficiently covers the passage opening. The operating and transmission elements may be arbitrary parts which are to be connected with arbitrary elements of the lock subassembly.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A door lock for a motor vehicle door, the door locking comprising: a premounted lock subassembly arranged in a hollow space of the vehicle door and fastened on a rearward frontal area of the vehicle door; a lock support on which is adjustably fastened a latch and a detent pawl which locks the latch in a closed position, the vehicle door further having a wall area which bounds the hollow space from an occupant compartment and has a passage opening through which a transmission element connected with the lock subassembly extends to a lock operating element arranged outside the hollow space, wherein an area of the lock subassembly covers the passage opening, and the transmission element, which is connected with the lock operating element is connected through the passage opening with a connecting element of the lock subassembly.

2. A door lock according to claim 1, wherein the transmission element is as adapted to be either detachably or undetachably connected through the passage opening with the connecting element of the mounted lock subassembly.

3. A door lock according to claim 1, wherein the connecting element of the lock subassembly is a plug connected by way of an electric line with the lock subassembly or a plug receiving device, and the electric line projects slightly through the passage opening out of the hollow space.

4. A door lock according to claim 1, wherein the transmission element is connected by way of a connector with the connecting element of the lock subassembly.

5. A door lock according to claim 1, wherein several transmission elements are each adapted to be connected by way of a passage opening with the connecting element of the lock subassembly after the lock assembly has been mounted on the vehicle door.

6. A door lock according to claim 5, wherein more than one passage openings are formed by a common passage opening.

7. A door lock according to claim 1, a seal is arranged between the wall area and the lock subassembly, extending around the passage opening close to the edge of the passage opening or at a distance from the edge of the passage opening to prevent moisture from entering an occupant compartment through the passage opening to the hollow space.

8. A door lock according to claim 1, wherein the lock operating element is an interior displaceable securing knob which, as a result of displacement, can block or adjust into an uncoupling position a lock part which is to be adjusted for the unlocking of the detent pawl, in which uncoupling position an unlocking movement of the detent pawl is prevented.

9. A door lock according to claim 1, wherein the lock operating element is an interior door grip.

10. A door lock according to claim 1, wherein the lock operating element includes a means for manually or remotely switching which, by way of an electric line, is to be connected directly or by way of a plug at the end of the electric line with an element of the lock subassembly.

11. A door lock according to claim 1, wherein the transmission element or a part connected therewith extends in areas between the wall area of the hollow space and a door covering part covering the wall area.

12. A door lock according to claim 1, wherein a seal to prevent moisture passing through the passage opening is positioned on said area of the lock subassembly around the passage opening.

13. A door lock according to claim 1, wherein the lock subassembly completely occludes the passage opening.

14. A door lock for a motor vehicle door, the door lock comprising:

a premounted lock subassembly arranged in a hollow space of the vehicle door and fastened on a rearward frontal area of the vehicle door, and a lock support on which is adjustably fastened a latch and a detent pawl which locks the latch in a closed position, the vehicle door further having a wall area which bounds the hollow space from an occupant compartment and which has a passage opening through which a transmission element connected with the lock subassembly extends to a lock operating element arranged outside the hollow space, wherein an area of the lock subassembly occludes the passage opening, and the transmission element, which is connected with the lock operating element, is connected through the passage opening with a connecting element of the sock subassembly.

15. A door lock for a motor vehicle door, the door lock comprising:

a premounted lock subassembly arranged in a hollow space of the vehicle door and fastened on a rearward frontal area of the vehicle door, a lock support on which is adjustably fastened a latch and a detent pawl which locks the latch in a closed position, the vehicle door further having a wall area which bounds the hollow space from an occupant compartment and which has a passage opening with a cross section through which a transmission element connected with the lock subassembly extends to a lock operating element arranged outside the hollow space, wherein an area of the lock subassembly covers and is adjacent to the cross section of the passage opening, and the transmission element, which is connected with the lock operating element, is connected through the passage opening with a connecting element of the lock subassembly.

16. A vehicle door locking assembly comprising:

a lock subassembly positioned in a rearward frontal area of a hollow space of a vehicle door, the vehicle door being provided with a wall area which bounds the hollow space from an occupant compartment and has a passage opening through which a transmission element connected with the lock subassembly extends to a lock operating element arranged outside the hollow space; and a lock support including an adjustably fastened latch and a detent pawl adapted to lock the latch in a closed position, wherein an area of the lock subassembly covers the passage opening, and the transmission element, which is connected with the lock operating element is connected through the passage opening with a connecting element of the lock subassembly.

17. A vehicle door locking assembly comprising:

a lock subassembly positionable within a hollow space of a vehicle door so as to cover a passage opening formed in a wall that covers the hollow space;

a lock support arranged within the lock subassembly further comprising, an adjustably fastened latching means for moving a latch between a closed position and an open position; and a transmission element having one end attached to a connecting element which extends through the passage opening and connects with the lock subassembly so as to operate the latching means, and another end extending to a lock operating element positioned outside the hollow space.

* * * * *